United States Patent [19]

Wilson

[11] 4,171,548

[45] Oct. 23, 1979

[54] TOILET

[76] Inventor: Thomas A. Wilson, 310 Thomas St., Roxana, Ill. 62084

[21] Appl. No.: 888,026

[22] Filed: Mar. 20, 1978

[51] Int. Cl.[2] ..... E03D 11/16

[52] U.S. Cl. ..... 4/421; 285/58

[58] Field of Search ..... 4/420, 421, 300, 211, 4/DIG. 16, DIG. 13, DIG. 2, 3, 252 R, 328, 344; 285/58, 179, 157

[56] References Cited

U.S. PATENT DOCUMENTS

| | | | |
|---|---|---|---|
| 377,776 | 2/1888 | Putnam | 4/252 R |
| 845,534 | 2/1907 | Delanoy | 4/252 R |
| 1,609,159 | 11/1926 | Dawson | 285/58 |
| 2,409,023 | 10/1946 | Dies | 285/157 |
| 2,866,981 | 1/1959 | McMinn | 4/211 |
| 2,878,483 | 3/1959 | Schmid | 4/300 |
| 3,037,212 | 6/1962 | Kleinhof | 4/252 R |
| 3,855,649 | 12/1974 | Morris et al. | 4/252 R |
| 3,860,978 | 1/1975 | Wirth | 285/157 |
| 3,967,324 | 7/1976 | Olive | 4/DIG. 16 |
| 4,023,833 | 5/1977 | Wellard | 285/179 |

*Primary Examiner*—Lenard A. Footland
*Attorney, Agent, or Firm*—Kalish & Gilster

[57] ABSTRACT

A toilet of the free-standing type having a bowl fixture adapted for being secured to a floor whereby there is a floor drain for receiving the bowl discharge, the floor drain being spaced by an indeterminately given rough-in distance from a wall. A tank fixture is secured to the bowl fixture with the tank fixture proximate the wall for supplying water for flushing of the toilet bowl. The bowl fixture includes a bowl siphon communicating with the bowl and the siphon having a discharge opening is spacedly remote from the floor drain. The discharge opening is presented rearwardly of the bowl and toward the wall. Connected at one end of the siphon discharge opening is a discharge conduit arrangement for receiving the bowl discharge via the siphon. Connected at its opposite end to the floor drain, such arrangement adjustably accommodates variation in the spacing between the siphon discharge opening and the floor drain to permit the bowl fixture to be secured to the floor at a desired location indpendent of the rough-in distance.

12 Claims, 4 Drawing Figures

TOILET

BACKGROUND AND SUMMARY OF THE INVENTION

The invention relates in general to the plumbing of floor-connected toilets and, more particularly, to the improved toilet of the free-standing type incorporating a universal plumbing unit for facile floor drain connection of the toilet.

Toilets which are adapted to have a toilet bowl discharge connected to a floor drain connection typically are specified in terms of a so-called rough-in distance. Such distance is the measure from the wall behind the toilet to the center of the drain pipe communicating with the floor drain. The floor drain typically includes a floor flange at which said floor drain terminates.

Modern toilets for installation in houses and other dwelling units are now most frequently of the so-called free-standing type. This type having a bowl fixture which is to be mounted and secured to a floor with the bowl thereof connected to a floor drain by means of said floor flange.

Among the types of toilets to which such considerations are applicable include the so-called wash-down, reverse trap, siphon jet and vortex siphon types. All such toilets have a bowl which is flushed by siphon action with discharge to the rear of the bowl, as contrasted with the older type wash-down type toilet having discharge to the front of the bowl. The present invention is concerned with toilets having discharge to the rear of the bowl.

Such free-standing toilets include a tank fixture adapted to be secured to the bowl fixture at the rear thereof with the tank fixture proximate to the wall behind the toilet. Tanks of this type are often referred to as bowl-mounted tanks.

When installed, it is not uncommon for there to be a spacing of up to several inches between the rear of the tank and the wall behind the toilet. In order to provide for some alignment of the tank with respect to the plane of the wall, modern toilets are designed so that the tank fixture is secured to the bowl fixture by means of a bolt and washer configuration providing a rather modest adjustment of the tank fixture with respect to the bowl fixture prior to tightening of such nut and bolt securements. However, such an adjustment feature permits no more than a slight degree of dimensional variation of the tank fixture with respect to the bowl fixture.

Accordingly, a critical factor in purchasing and installing a toilet is the specification of such toilet by the so-called rough-in distance from the wall to the center of the drain pipe. A floor-mount toilet of present modern type are conventionally of a precast configuration and are manufactured in various sizes according to said desired rough-in distance. To illustrate, toilets are conventionally available in different sizes to provide rough-in distances of 10", 12" or 14", for example.

As a practical matter, the construction of a house often involves a very real problem in that after a house is "roughed in", the plastered or finished wall which will be behind a toilet after same is to be installed, frequently is found to be spaced from the floor drain by a distance other than that desired. Although the builder of the house or other dwelling may intend for there to be a rough-in distance of, for example, 12", it may be found that because of variations in plumbing, carpentry, the application of interior siding materials, or generally because of the tolerances invariably inherent in the construction of the house or other dwelling, the actual rough-in distance may be quite different, perhaps by several inches, from that desired.

If a toilet has already been ordered for installation before construction is finished, it may have been specified to have a rough-in distance different from that which will have been found to have been desirable upon completion of construction of the house or other dwelling. In such event, the toilet must be exchanged for a toilet of proper size or, in extreme cases, expensive plumbing or carpentry changes must be effected prior to installation of the toilet. In other words, as a result of such errors or inprecision in construction, the rough-in distance from the wall is an indeterminately given dimension.

A related problem is that the termination of the soil pipe constituting a floor drain which is conventionally at a floor flange may be such that the floor drain terminates at an indeterminately given elevation relative to the surface level of the floor. For example, the floor flange may be level with the floor or may be an inch or two below the actual surface of the floor when such floor has been installed, it being understood that the plumbing of the floor drain and consequently the level of the floor flange is determined precedent to the installation and finishing of the floor upon which the toilet is to be mounted.

For these reasons, it is desirable for a toilet to be of a configuration permitting accommodation for variations in the actual rough-in distance, as well as for any variations between the termination of the floor drain at its flange and the level of the floor upon which the toilet is to be mounted and secured.

An object of the present invention is, therefore, the provision of a new toilet having a drain plumbing arrangement for adjustably accommodating variations in rough-in distance.

A related object of the invention is the provision of such an improved toilet providing for accommodation of variations in the spacing between the floor drain and the floor upon which the toilet is to be mounted.

A related object of the invention is the provision of an improved plumbing unit for use in a toilet where the toilet has a siphon discharge opening which is spacedly remote from a floor drain.

A further object of the invention is the provision of such a plumbing unit which adjustably accommodates variations in the vertical and horizontal spacing between the siphon discharge opening and the floor drain.

Another object of the invention is the provision of such toilet and plumbing unit which conduce to extremely facile installation of the toilet, notwithstanding variations in rough-in distance or spacing between a floor drain flange and the floor having such floor drain.

Another object of the invention is the provision of a plumbing unit of one form which is of a simple, knock-down configuration so as to provide for compact containment or shipment thereof and yet is such as to facilitate installation.

A related object is the provision of such a plumbing unit of another form which is of such construction as to be readily deformed, bent, folded, or the like, without damage thereto and to facilitate containment or shipment thereof while achieving other objects of the invention.

Yet another object of the invention is the provision of such a toilet and plumbing unit utilizing readily available, low cost and durable components and yet which is of a universal character.

Other objects and features will be apparent and, in part, pointed out hereinafter.

BRIEF DESCRIPTION OF THE DRAWINGS

Corresponding reference characters indicate corresponding parts through the several views of the drawings.

DESCRIPTION OF THE PREFERRED EMBODIMENT

Figure 1:
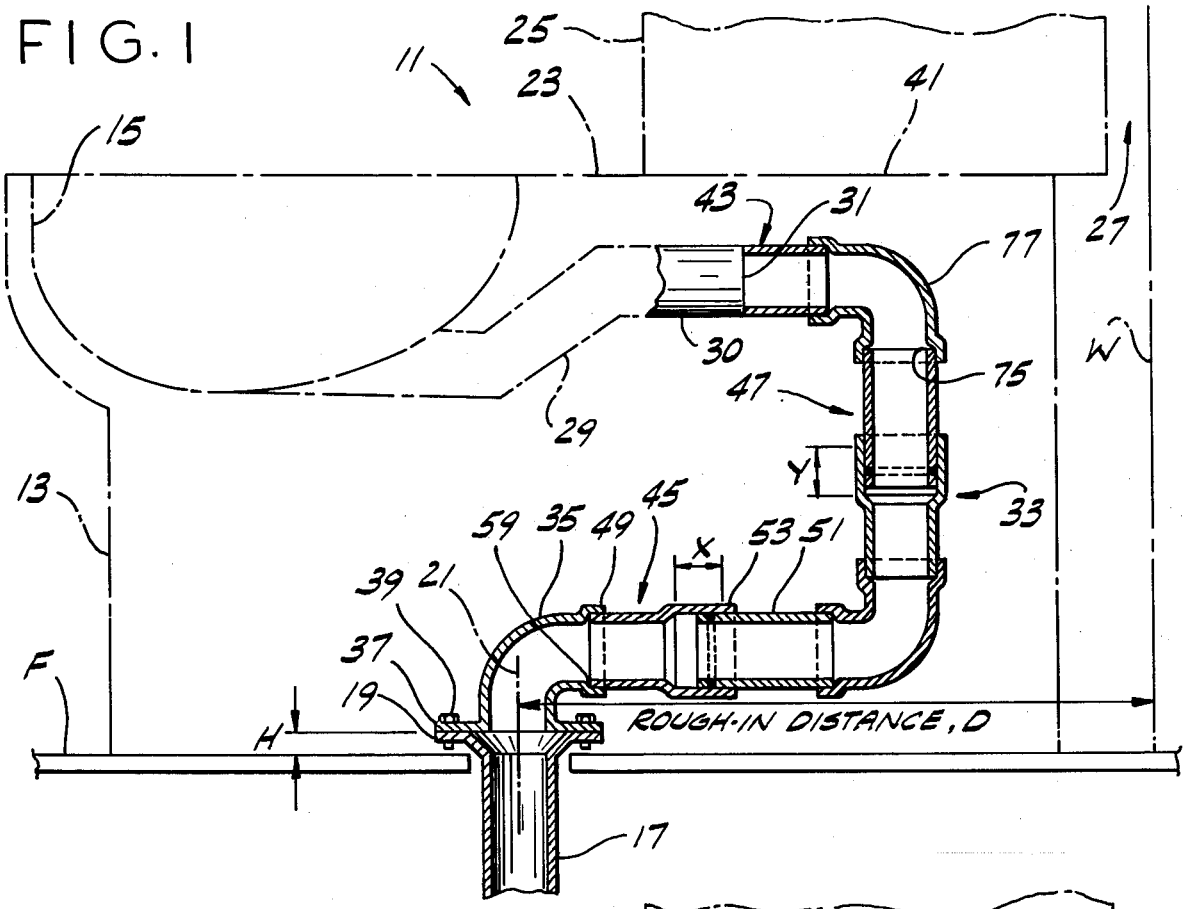
FIG. 1 is side elevational view of a schematic nature, and partly in cross-section, illustrating a new toilet of the invention including a first preferred embodiment of a plumbing unit.

Referring now to FIG. 1, there is illustrated generally at 11 a toilet of the free-standing type having a bowl fixture 13 adapted to be mounted upon and secured to a floor F said toilet having the usual bowl 15. At 17 is designated the soil pipe providing a floor drain for receiving discharge from bowl 15, the drain having a floor flange 19 of the usual configuration.

The rough-in distance B from the center line 21 of drain 17 to a wall W behind the toilet 11 is, as noted, an indeterminately given dimension dependent upon the vagaries and imprecision of construction and other factors inherent in carpentry and/or plumbing of the soil pipe or drain 17 associated with the premises in which the present toilet 11 is to be installed.

Although not shown, it will be understood that bowl fixture 13 has the usual base flange having apertures therein on opposite sides of bowl 15 and also rearwardly of the bowl for securing fixture 13 to floor F.

In conventional fashion, bowl 15 is presented in the top surface 23 of bowl fixture 13 and opens upwardly from the front of the bowl fixture. Such unit is, of course, provided with the usual seat and bowl cover and such structure is not, in the interest of clarity and simplicity, illustrated in the drawings.

Indicated at 25 is a tank fixture which is secured to bowl fixture 13 at the rear thereof with the tank fixture proximate wall W, there being if desired a space 27 between the wall and the rear of tank 25 in order to permit cleaning or painting, etc. of the wall. However, such space 27 is a matter of preference and may be eliminated when utilizing a toilet of the new configuration illustrated, as will become apparent from the following description.

In any event, tank 25 is adapted for supplying water for flushing of bowl 15, it being understood that the toilet includes the usual bowl siphon 29 communicating with the bottom of bowl 15. The siphon has an extension 30 terminating in a siphon discharge opening 31 spaced rearwardly of bowl 15. The siphon discharge opening is also spacedly remote from the floor drain flange 19, such siphon discharge opening being well to the rear and thus horizontally remote from drain flange 19 but also vertically spaced therefrom as shown.

In accordance with the new plumbing unit of the present invention, indicated generally at 33 is a discharge conduit means connected at one end to siphon discharge opening 31 for receiving discharge B at siphon 29. Said discharge conduit means 33 is connected at the opposite end to floor drain flange 19 via an elbow 35. Elbow 35 has a flange 37 which is mated to and secured by bolts or the like as shown at 39, it being understood that a gasket or washer, or the like, for enhancing the seal between flanges 19 and 37 may be employed, if so desired.

More specifically, siphon discharge opening 31 lies in a plane which is generally perpendicular to floor F and thus also parallel to wall W. The discharge conduit means 33 serves the purpose of adjustably accommodating variations in the spacing between the siphon discharge opening 31 and floor drain 19, i.e., with reference to the center line 21 of floor drain 17 so as to permit the bowl fixture 23 to be mounted and secured to floor F at the desired location substantially independent on the rough-in distance D, it being apparent that such location may in fact be predicated upon the spacing desired between tank fixture 25 and wall W.

It is to be understood that bowl fixture 13 may be of the usual pre-cast construction so as to have integrally molded therein suitable passageways or conduits for the flow of water in tank fixture 25 to bowl 15 for flushing of the toilet, such passages being entirely conventional and thus not illustrated in the interest of clarity. In any event, sufficient space is retained rearwardly of bowl 15 so that siphon discharge opening 31 is positioned below tank fixture 25 and thus below the top surface 23 which, in usual fashion, is substantially parallel to floor F. Again, the rear portion of top surface 23 is designated 41 and tank fixture 25 is secured in conventional manner as by a bolt and nut securement to rear portion 41 of the top surface of bowl fixture 13, there being gasketing or the like providing a seal between bowl fixture 13 and tank fixture 25 as appropriate.

It will also be appreciated that inasmuch as flange 19 of floor drain 17 terminates at an indeterminately given elevation relative to the surface level of floor F there is a vertical spacing between the siphon discharge opening 31 and the termination, i.e., flange 19 of floor drain 17. Such vertical spacing is subject to variation. Accordingly, discharge conduit means 33 adjustably accommodates variation in the vertical spacing between the siphon discharge opening 31 and floor drain flange 19.

More specifically, discharge conduit means 33 comprises a first portion or length 43 connected to siphon discharge opening 31, a second portion or length designated generally 45 connected to floor drain flange 19 via elbow 35, and a third portion or length designated generally 47 intermediate and interconnecting the first and second portions 43, 45.

Figure 3:
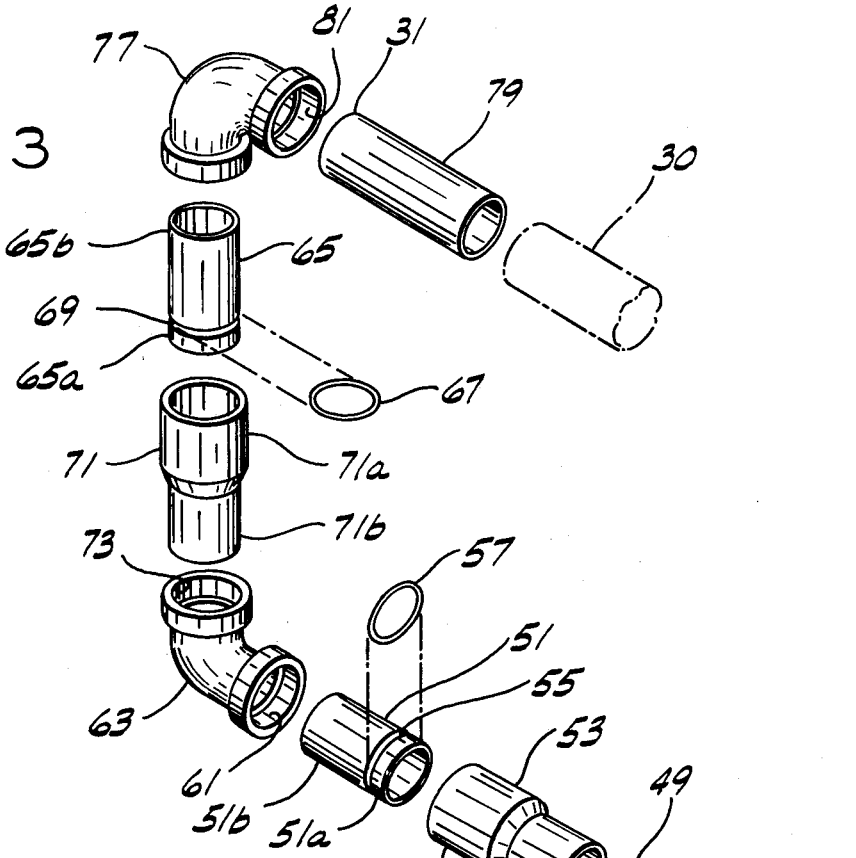
FIG. 3 is an exploded perspective view of a plumbing unit of the embodiment depicted in FIG. 1.

As will be apparent from reference to FIG. 1 and particularly FIG. 3, wherein the fluid discharge means 33 is shown in exploded perspective view, portions 43, 45 and 47 of fluid discharge means 33 are each of a tubular configuration. Elbow 35 to which portion 45 is connected is of a right-angle configuration so that its outlet is directed downward towards floor drain 17 and has an outlet flange 37 mated to flange 19 of floor drain 17. The inlet 49 of elbow 35 faces toward wall W, said inlet lying in a plane substantially perpendicular to floor F and thereby parallel to wall W. The second portion 45 and third portion 37 of the fluid conduit means 33 are each constituted by a telescoping assembly. For example, portion 45 includes a first horizontal member 51 and a sleeve-like tubular second horizontal member 53 disposed in telescoping relationship upon member 51, there being an O-ring seal for providing sealing relationship between the first and second horizontal members 51, 53.

Referring to FIG. 3, horizontal member 51 is provided with a groove 55 proximate one end 51*a* thereof, there being an O-ring 57 seated in said groove. Sleeve-like member 45 has an increased diameter portion 53*a* adapted to encircle and fit in telescoping relation over portion 51*a* which carries O-ring 57, there being a reduced diameter portion 53*b* adapted to fit within a corresponding seat 59 of inlet 49 of elbow 35. The other end of 51*b* of member 51 is adapted to be received by a seat 61 in an elbow 63 interconnecting portion 45 and 47 of the discharge conduit means.

Vertical portion 47 of the discharge conduit means similarly comprises a tubular first vertical member 65 having a portion 65*a* carrying an O-ring 67 in a groove 69 encircling said portion 65*a*. A sleeve-like tubular second vertical member 71 has an enlarged diameter portion 71*a* disposed in telescoping relationship upon portion 65*a* of member 65, said O-ring 67 providing a sealing relationship between first and second vertical members 65 and 71. The latter member 71 includes a reduced diameter portion 71*b* adapted to fit securely into a seat 73 of elbow 63. Similarly, member 65 includes a terminal portion 65*b* adapted to fit securely into a seat 75 (see FIG. 1) of a further elbow 77. The siphon extension 30 extending rearwardly toilet bowl 15 provides said siphon discharge opening 31 which is adapted to be suitably secured to a tubular length of conduit which is fitted securely into a seat 71 providing an inlet of elbow 77.

Figure 4:
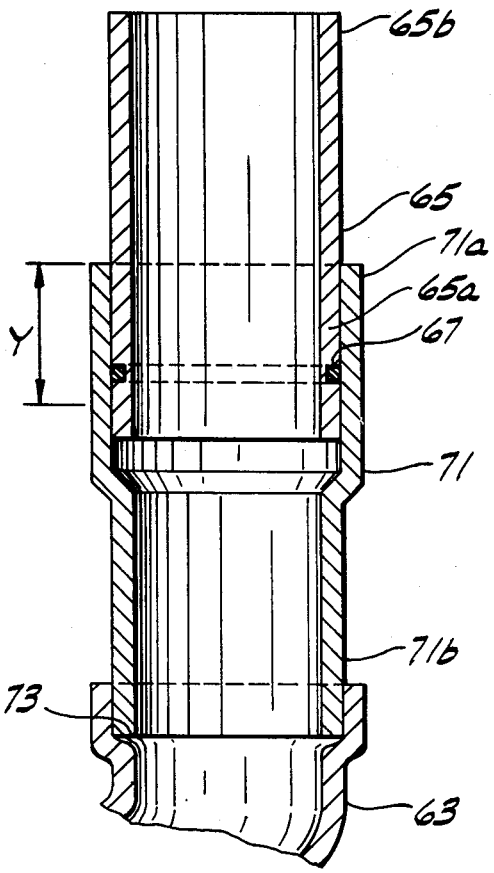
FIG. 4 is a cross-sectional view through a telescoping assembly utilized in the embodiment of a plumbing unit illustrated in FIGS. 1 and 3.

The detailed arrangement of each of these telescoping assemblies is illustrated in enlarged detail in FIG. 4 where the drawing illustrates that each such assembly provides a predetermined extent of adjustability in length. With reference to FIG. 1, it will be seen that portion 47 provides adjustment in the vertical spacing between siphon discharge outlet 31 and floor drain flange 19 by a dimension Y, whereas portion 45 permits horizontal adjustment in the separation between the siphon discharge opening 31 and floor drain flange 19 over a distance X.

In a completed assembly as is illustrated in FIG. 1, it is preferred that a rigid connection of the tubing portions to the elbow flanges be effected. In this regard, discharge conduit means 33 may be constructed in its entirety of a synthetic resin material such as polyvinylchloride (PVC), with the exception of the O-rings which are of synthetic rubber-like material such as "Neoprene" or the like. In such case, rigid connections at the elbow flanges may then conveniently be effected through the use of a cement intended for use with PVC. Use of PVC material advantageously provides a light assembly and, since discharge conduit means 33 may be shipped in a knocked-down form which is readily containerized in a small package, it may thereafter be assembled as depicted, cement or the like being employed at the flanges of the elbows for providing a rigid construction as desired. Of course, other materials such as various metals, alloys or plated metallic constructions of the type employed in the plumbing industry may instead be used.

Figure 2:
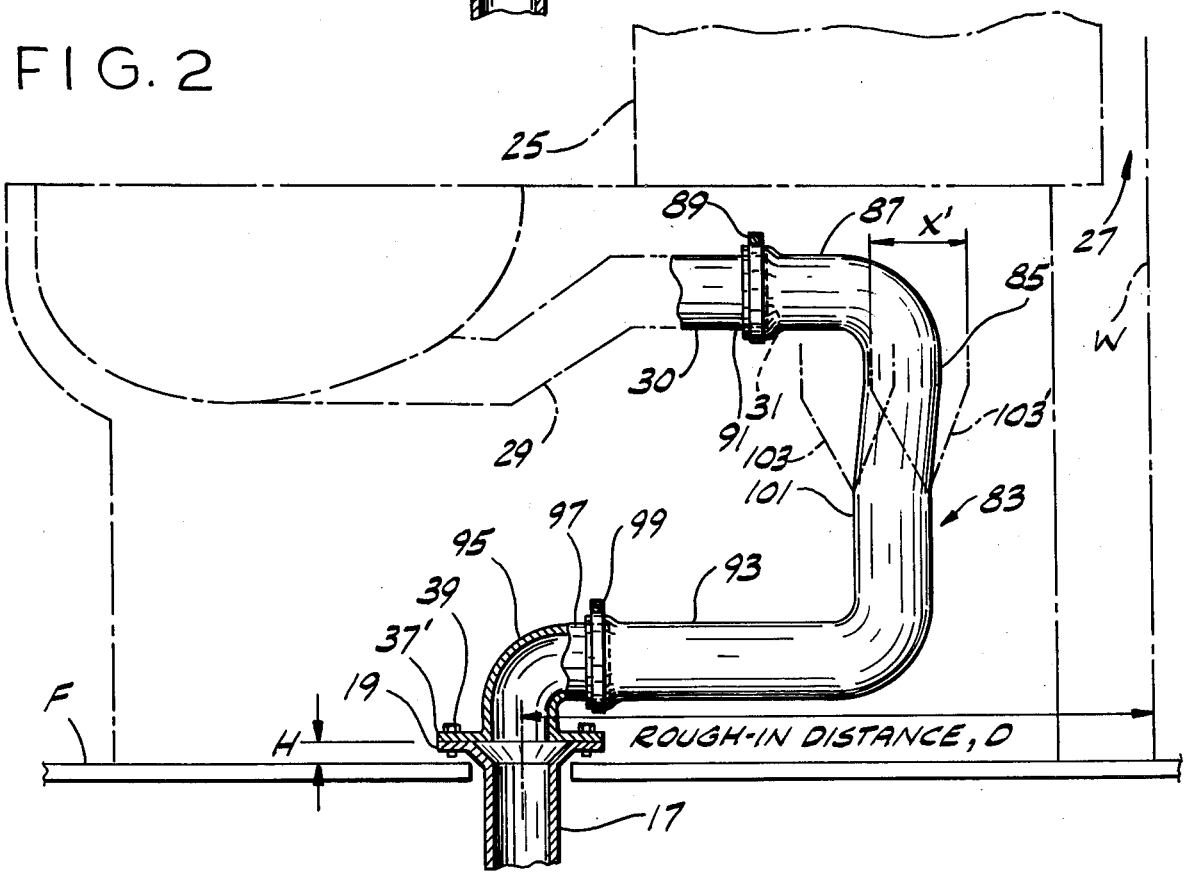
FIG. 2 is a side elevational view like that of FIG. 1 but illustrating another preferred embodiment of a plumbing unit of the invention in a toilet like that of FIG. 1.

Referring now to FIG. 2, an alternative embodiment of the invention is illustrated wherein the conduit discharge means shown interconnected with the siphon discharge opening 31 is of an alternative configuration designated generally 83. More particularly, such discharge conduit means is constituted by a piece of tubing comprising a unitary preformed tube of flexible synthetic material, the tube in its entirety being designated 85.

Tube 85 has a first length 87 connected to an extension 30 of the siphon by a clamp 89 surrounding a marginal portion 91 of the end of siphon extension 30. Length 87 of the tube is generally horizontal, as is extension 30. Another generally horizontal length 93 of tube 85 is connected to an elbow 95 of the same general configuration as elbow 35 illustrated in FIG. 1, elbow 95 having a similar flange 37' which is bolted to floor drain flange 19 by suitable bolt and nut securements 39 or the like. However, elbow 95 has a constant diameter inlet portion 97 over which length 93 is extended and secured by a clamp 99. These first and second horizontal lengths of tube 85 are joined by an upright, approximately vertical length 101, said tubing 85 thereby being approximately J-shaped.

While various flexible synthetic materials including synthetic resin materials may be employed to provide the single integral construction of the tube 85, such tubing may preferably be constituted of reinforced synthetic rubber material of premolded configuration in the J-shape illustrated so that the generally desired shape will be present when the toilet is ready for installation, yet by virtue of its inherent resiliency and flexibility will permit various adjustments upon installation.

Hence, tube 85 will accommodate variations in the spacing between siphon discharge outlet 31 and floor drain flange 19 according not only to the level above the floor at which the floor drain flange 19 terminates, but also in accordance with any expected variation in the rough-in distance D. Tube 85 permits both vertical and horizontal movement of bowl fixture 13 upon installation so that the bowl fixture is permitted to be mounted and secured to the floor at the desired location substantially independent of the rough-in distance or the vertical termination of floor drain 17.

Although the vertical spacing of the termination of floor drain 17 above level of floor F may be relatively slight compared to any expected variation in the rough-in distance D, considerable lassitude in variations between the spacing both horizontally and vertically of the siphon discharge opening 31 and floor drain 19 is permitted by the inherent resiliency and flexibility of tubing 101. Dashed line positions 103, 103' are illustrated at FIG. 2 to demonstrate variations in the horizontal spacing between the termination of floor drain 17 at its flange 19, on the one hand, and between the siphon discharge opening 31, on the other hand, so as to provide an extent of horizontal adjustment X', as shown.

A benefit which inures to the user of the new toilet and plumbing unit configuration illustrated in FIG. 2 is that installation of the toilet is accomplished in a most facile manner, owing to the ease by which tubing length 87 may be secured to margin 91 of discharge siphon extension 30 by means of clamp 89. Because of the simple connection of length 93 to elbow margin 97 by means of clamp 99, pre-installation of the plumbing unit within the toilet is permitted. Subsequent bolting of flange 37′ to flange 19 by means of bolts 39 or the like while the bowl fixture 13 is elevated slightly from floor F is then easily accomplished because of the ready access to flange bolts 39 or the like. Bowl fixture 13 is then located at a desired position so as to provide an appropriate distance 27 between tank fixture 25 and wall W. Bowl fixture 13 is then secured to floor F in conventional fashion.

Installation of the embodiment of FIG. 1 is similarly facilitated by the provision of the vertical telescoping assembly 47. This assembly permits flange 37 to be first bolted or otherwise secured to floor drain flange 39 by said bolt 39 or the like with length 51 of the discharge conduit means 39 with portion 71 of telescoping assembly 47 already in place. Similarly, to siphon discharge extension 30 is previously secured length 43 of the fluid discharge means, elbow 77 and portion 65 telescoping assembly 33 having previously been secured together. Accordingly, it is then a simple matter to lower bowl fixture 13 in place to provide the telescoping relationship of assembly 47 which is illustrated in FIG. 1, bowl unit 13 being positioned in the horizontal direction (that is, left to right across the sheet of drawings) until the spacing 27 between tank fixture 25 and wall W is as desired. Bowl fixture 13 is then suitably secured to floor F.

In view of the foregoing, it is seen that the several objects of the invention are achieved and other advantageous results are obtained.

Although the specific embodiments described or shown herein include a description of the best mode contemplated for carrying out the invention, various modifications unless preferred embodiments are presently contemplated. Accordingly, the foregoing description is intended to be illustrative, the scope of the invention being indicated by the following claims wherein all variations within the range of equivalence are intended to be encompassed.

Having described my invention what I claim and desire to obtain by Letters Patent is:

1. A toilet of the free-standing type comprising a bowl fixture including a housing adapted to be mounted upon and secured to a floor, said housing including a bowl, said floor having a floor drain fixed in position for receiving discharge from said bowl, said floor drain being located below said toilet and spaced an indeterminately given rough-in distance outward from a wall, said bowl fixture having a top surface, said bowl presented in said top surface and opening upwardly from the front of said bowl fixture, a tank fixture secured to said bowl fixture at the rear of said bowl fixture with said tank fixture proximate said wall, said tank fixture being adapted for supplying water for flushing of said bowl, said bowl fixture comprising a bowl siphon communicating with said bowl, said siphon havinng a discharge opening located within said bowl fixture housing and spacedly remote from said floor drain when said bowl fixture housing is mounted upon said floor, said discharge opening being presented rearwardly of said bowl and toward said wall, and discharge conduit means located within said bowl fixture housing and connected at one end to said siphon discharge opening for receiving discharge via said siphon from said bowl upon flushing thereof, and connected at the opposite end at a connection location to said floor drain for providing said discharge to said floor drain, said discharge conduit means adjustably accommodating variation in the spacing between said siphon discharge opening and said floor drain to permit said bowl fixture to be mounted upon and secured to said floor at a desired location substantially independent of said rough-in distance said connection location being accessible from outside said wall and above said floor.

2. A toilet according to claim 1 and further characterized by said siphon discharge opening lying in a plane substantially perpendicular to said floor.

3. A toilet according to claim 2 and further characterized by said top surface of said bowl fixture lying in a plane substantially parallel to said floor, said top surface having a rear portion, said tank fixture being mounted upon said rear portion, said siphon discharge opening being positioned below the rear portion of said top surface.

4. A toilet according to claim 1 wherein the horizontal spacing between said siphon discharge opening and said floor drain is subject to variation in accordance with the positioning of said toilet to said desired location, said toilet being further characterized by said discharge conduit means accommodating variation in the horizontal spacing between said siphon discharge opening and said floor drain.

5. A toilet according to claim 4 wherein said floor has a surface level, and said drain terminates at an indeterminately given elevation relative to said surface level, so that vertical spacing between said siphon discharge opening and the termination level of said floor drain is subject to variation, said toilet being further characterized by said discharge conduit means adjustably accommodating variation in the vertical spacing between said siphon discharge opening and said floor drain.

6. A toilet according to claim 5 and further characterized by said discharge conduit means comprising a first conduit length connected to said siphon discharge opening, a second conduit length connected to said floor drain and a third conduit length intermediate and interconnecting said first and second portions.

7. A toilet according to claim 6 and further characterized by said first, second and third lengths each being of tubular configuration, said floor drain having a floor flange, said second length being secured to said floor flange by an elbow located within said housing.

8. A toilet according to claim 7 and further characterized by said elbow having an outlet and an outlet flange mated to said floor flange, said elbow having an inlet, said inlet facing toward said wall, said second length of said discharge conduit means being secured at one end thereof to said elbow inlet.

9. A toilet according to claim 7 and further characterized by said first, second and third lengths of said discharge conduit means being constituted by a single integral piece of tubing of flexible material.

10. A toilet according to claim 9 further characterized by said piece of tubing comprising a unitary preformed tube of flexible synthetic material, said first length thereof being generally horizontal, said third length interconnecting said first and second lengths being generally vertical.

11. A toilet according to claim 10 and further characterized by said third length of said discharge conduit means comprising a telescoping assembly constituted by a tubular first vertical member disposed in telescoping relationship upon said first vertical member, and an O-ring seal for providing sealing relationship between said first and second vertical members, thereby accommodating veriation in said vertical spacing.

12. A toilet according to claim 7 and further characterized by said second length of said discharge conduit means comprising a telescoping assembly constituted by a tubular first horizontal member and a sleeve-like tubular second horizontal member disposed in telescoping relationship upon said first horizontal member, and an O-ring seal for providing sealing relationship between said first and second horizontal members, thereby accommodating variation in said horizontal spacing.

* * * * *